US007328894B2

(12) United States Patent
Terao et al.

(10) Patent No.: US 7,328,894 B2
(45) Date of Patent: Feb. 12, 2008

(54) SHEET FINISHING APPARATUS

(75) Inventors: Yasunobu Terao, Shizuoka-ken (JP); Tomomi Iijima, Shizuoka-ken (JP); Mikio Yamamoto, Shizuoka-ken (JP); Takahiro Kawaguchi, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 261 days.

(21) Appl. No.: 11/085,264

(22) Filed: Mar. 22, 2005

(65) Prior Publication Data

US 2006/0214345 A1 Sep. 28, 2006

(51) Int. Cl.
*B65H 37/04* (2006.01)

(52) U.S. Cl. ..... 270/58.15; 270/58.08; 270/58.09; 270/58.1; 270/58.11; 270/58.12; 270/58.13; 270/58.14; 270/58.16; 270/58.17; 270/58.19; 270/58.28; 399/124; 399/125; 399/407; 399/408; 399/410

(58) Field of Classification Search ..... 270/58.08, 270/58.09, 58.1, 58.11, 58.12, 58.13, 58.14, 270/58.15, 58.16, 58.17, 58.19, 58.28; 399/124, 399/125, 407, 408, 410
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,849,796 A 7/1989 Murakami
4,898,374 A 2/1990 Vermaat
4,917,366 A 4/1990 Murakami et al.
5,020,784 A 6/1991 Asami et al.

(Continued)

FOREIGN PATENT DOCUMENTS

JP 61-078162 U 5/1986

(Continued)

OTHER PUBLICATIONS

U.S. Appl. No. 11/085,226, filed Mar. 22, 2005, Terao et al.

(Continued)

*Primary Examiner*—Gene C. Crawford
*Assistant Examiner*—Leslie A Nicholson, III
(74) *Attorney, Agent, or Firm*—Foley & Lardner LLP

(57) ABSTRACT

A sheet finishing apparatus of the present invention has a gate for taking in sheets of paper ejected from an image forming apparatus through a taking-in port and switching to either of a conveying path for post processing or a conveying path for non-post processing to convey the sheets of paper and a tray attached to the upper part of the sheet finishing apparatus by a link mechanism, and the tray can rotate between the height position for storing sheets of paper and the height position away from the upper part and keeps the angle of inclination thereof constant at either of the height positions, and furthermore, sheets of paper taken in from the taking-in port are clamped and conveyed by a pair of rollers, and one of the pair of rollers is supported by a sheet guidance member, and the sheet guidance member rotates in connection with the link mechanism and can cope with paper jamming, if any.

6 Claims, 14 Drawing Sheets

U.S. PATENT DOCUMENTS 5,098,074 A 3/1992 Mandel et al.
5,282,611 A 2/1994 Ueda et al.
5,285,249 A 2/1994 Mahoney
5,289,251 A 2/1994 Mandel et al.
5,337,134 A 8/1994 Sato et al.
5,370,384 A 12/1994 Romanowski
5,418,606 A 5/1995 Kikuchi et al.
5,435,544 A 7/1995 Mandel
5,449,157 A 9/1995 Kawano et al.
5,451,037 A 9/1995 Lundstrom
5,590,871 A 1/1997 Okabe et al.
5,622,359 A 4/1997 Kawano et al.
5,628,502 A 5/1997 Amarakoon
5,640,232 A 6/1997 Miyake et al.
5,676,517 A 10/1997 Lotz
5,709,376 A 1/1998 Ushirogata
5,767,884 A 6/1998 Bortolotti et al.
5,934,140 A 8/1999 Jackson et al.
5,961,274 A 10/1999 Bors
5,971,384 A 10/1999 Asao
6,022,011 A 2/2000 Hirose
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A 11/2000 Arai
6,146,085 A 11/2000 Namba et al.
6,179,287 B1 1/2001 Watanabe et al.
6,231,039 B1 5/2001 Chung
6,330,999 B2 12/2001 Coombs et al.
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 9/2002 Coombs
6,581,922 B2 6/2003 Kuwata et al.
6,600,885 B2 7/2003 Kida
6,641,129 B2 11/2003 Ogita et al.
6,659,455 B2 12/2003 Endo et al.
6,671,492 B2 12/2003 Mimura et al.
6,674,983 B2 * 1/2004 Enomoto et al. ..... 399/124
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 * 11/2004 Nagata et al. ..... 270/58.08
6,848,685 B2 * 2/2005 Katsuyama ..... 271/162
6,871,042 B2 3/2005 Nemura et al.
6,910,686 B2 6/2005 Awano
6,928,259 B2 8/2005 Sakuma
6,988,728 B2 1/2006 Kida
7,104,538 B1 9/2006 Kimura et al.
2002/0047233 A1 4/2002 Coombs et al.
2002/0053766 A1 5/2002 Kubota
2002/0074708 A1 * 6/2002 Nagata et al. ..... 270/58.08
2002/0163119 A1 11/2002 Kawata
2003/0057625 A1 3/2003 Kuwata et al.
2003/0155705 A1 8/2003 Sekiyama et al.
2003/0214090 A1 11/2003 Kato et al.
2004/0032073 A1 2/2004 Sasamoto
2004/0113348 A1 6/2004 Awano
2004/0126163 A1 7/2004 Asami et al.
2004/0181308 A1 9/2004 Hayashi et al.
2005/0000336 A1 1/2005 Hattori et al.

FOREIGN PATENT DOCUMENTS

JP 62-008965 A 1/1987
JP 63-035756 U 3/1988
JP 02-055369 A 2/1990
JP 03-088667 A 4/1991
JP 04-079857 U 7/1992
JP 04-312894 A 11/1992
JP 04-354756 A 12/1992
JP 05-238103 A 9/1993
JP 7-100563 B2 11/1995
JP 08-259073 A 10/1996
JP 09-309659 A 12/1997
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-208967 A 8/1999
JP 11-231753 A 8/1999
JP 11-301912 A 11/1999
JP 2000-095420 A 4/2000
JP 2000-159414 A 6/2000
JP 2001-048411 A 2/2001
JP 2001-089009 A 4/2001
JP 2001-316029 A 11/2001
JP 2002-060118 A 2/2002
JP 2002-308509 A 10/2002
JP 2003-081517 A 3/2003
JP 2003-171057 A 6/2003
JP 2003-192210 A 7/2003
JP 2003-246536 A 9/2003
JP 2003-335450 A 11/2003
JP 2004-142868 A 5/2004

OTHER PUBLICATIONS

U.S. Appl. No. 11/085,227, filed Mar. 22, 2005, Terao et al.
U.S. Appl. No. 11/085,248, filed Mar. 22, 2005, Terao et al.
U.S. Appl. No. 11/085,240, filed Mar. 22, 2005, Terao et al.
U.S. Appl. No. 11/085,247, filed Mar. 22, 2005, Terao et al.
U.S. Appl. No. 11/085,250, filed Mar. 22, 2005, Terao et al.
U.S. Appl. No. 11/085,244, filed Mar. 22, 2005, Terao et al.
U.S. Appl. No. 11/085,243, filed Mar. 22, 2005, Terao et al.
U.S. Appl. No. 11/085,242, filed Mar. 22, 2005, Terao et al.
U.S. Appl. No. 11/085,241, filed Mar. 22, 2005, Terao et al.
U.S. Appl. No. 11/085,625, filed Mar. 22, 2005, Terao et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.

U.S. Appl. No. 11/008,295, filed Dec. 10, 2004, Terao et al.
U.S. Appl. No. 11/008,251, filed Dec. 10, 2004, Terao et al.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., U.S. PTO Office Action, U.S. Appl. No. 11/008,132, filed Jun. 9, 2006, with attached Notice of Withdrawal from Issue dated May 30, 2006, 11 pgs.
Y. Terao et al., U.S. PTO Office Action, U.S. Appl. No. 11/008,295, filed Jun. 23, 2006, 14 pgs.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,392, filed Sep. 15, 2006, 10 pages.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,567, filed Aug. 21, 2006, 14 pages.
Y. Terao et al., Notice of Allowance and Fee(s) Due, U.S. Appl. No. 11/008,222, filed Aug. 31, 2006, 12 pages.
Y. Terao et al., Notice of Allowance and Fee(s) Due, U.S. Appl. No. 11/008,299, filed Sep. 6, 2006, 9 pages.
Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,567, filed Mar. 1, 2007, 6 pages.
Y. Terao et al., Notice of Allowance and Fee(s) Due, U.S. Appl. No. 11/085,247, filed Feb. 28, 2007, 14 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/085,226, filed Jan. 29, 2007, 6 pages.
Y. Terao et al., U.S. PTO Office, U.S. Appl. No. 11/008,290, filed Mar. 9, 2007, 8 pages.
Y. Terao et al., U.S. PTO Office, U.S. Appl. No. 11/085,240, filed Mar. 12, 2007, 15 pages.
Y. Terao et al., U.S. PTO Office, U.S. Appl. No. 11/085,242, filed Mar. 23, 2007, 20 pages.
Y. Terao et al., U.S. PTO Office, U.S. Appl. No. 11/085,248, filed Apr. 10, 2007, 12 pages.
Y. Terao et al., U.S. PTO Office, U.S. Appl. No. 11/085,257, filed Mar. 23, 2007, 23 pages.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
Y. Terao et al., Notice of Allowance and Fee(s) Due, U.S. Appl. No. 11/085,224, filed Jul. 13, 2006, 10 pages.
Y. Terao et al., U.S. PTO Office Action, U.S. Appl. No. 11/008,145, filed Jun. 30, 2006, 6 pgs.
Y. Terao et al., U.S. PTO Office Action, U.S. Appl. No. 11/008,147, filed Jul. 7, 2006, 4 pgs.
Y. Terao et al., U.S. PTO Office Action, U.S. Appl. No. 11/008,290, filed Jul. 21, 2006, 15 pgs.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,240, filed Aug. 2, 2006, 15 pages.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao et al., Notice of Allowance and Fee(s) Due, U.S. Appl. No. 11/008,122, filed Jul. 26, 2006, 8 pgs.
U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, filed Mar. 22, 2005, Iizuka et al.
Y. Terao et al., Notice of Allowance and Fee(s) Due, U.S. Appl. No. 11/008,132, filed Oct. 6, 2005, 9 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.

Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13, 2005, 9 pages.
Y. Terao et al., U.S. PTO Office Action, U.S. Appl. No. 11/008,349, filed Dec. 13, 2005, 9 pages.
Y. Terao et al., U.S. PTO Office Action, U.S. Appl. No. 11/008,567, filed Dec. 13, 2005, 9 pages.
Y. Terao et al., Notice of Allowance and Fee(s) Due, U.S. Appl. No. 11/008,124, filed Sep. 30, 2005, 9 pages.
Y. Terao et al., Notice of Allowance and Fee(s) Due, U.S. Appl. No. 11/008,290, filed Aug. 2, 2007, 9 pages.
Y. Terao et al., Notice of Allowance and Fee(s) Due, U.S. Appl. No. 11/008,299, filed Jul. 23, 2007, 10 pages.
Y. Terao et al., Notice of Allowance and Fee(s) Due, U.S. Appl. No. 11/085,240, filed Jul. 24, 2007, 20 pages.
Y. Terao et al., Notice of Allowance and Fee(s) Due, U.S. Appl. No. 11/085,248, filed Aug. 16, 2007, 8 pages.
Y. Terao et al., U.S. PTO Office Action, U.S. Appl. No. 11/085,257, filed Jul. 16, 2007, 12 pgs.
Y. Terao et al., Notice of Allowance and Fee(s) Due, U.S. Appl. No. 11/008,142, filed Jan. 5, 2007, 24 pages.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/085,248, filed Oct. 24, 2006, 12 pages.
C. Iizuka et al., U.S. PTO Office Action, U.S. Appl. No. 11/085,251, filed Jun. 25, 2007, 28 pgs.
Y. Terao et al., Notice of Allowance and Fee(s) Due, U.S. Appl. No. 11/008,132, filed Jun. 1, 2007, 11 pgs.
Y. Terao et al., Notice of Allowance and Fee(s) Due, U.S. Appl. No. 11/008,294, filed Jun. 14, 2007, 6 pgs.
Y. Terao et al., Notice of Allowance and Fee(s) Due, U.S. Appl. No. 11/008,381, filed Jun. 29, 2007, 6 pgs.
Y. Terao et al., U.S. PTO Office Action, U.S. Appl. No. 11/085,242, filed Jul. 10, 2007, 9 pgs.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,625, filed Jul. 10, 2007, 11 pgs.
Y. Terao et al., U.S. PTO Office Action, U.S. Appl. No. 11/008,131, filed Oct. 17, 2006, 15 pages.
Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,230, filed Nov. 13, 2006, 17 pages.
Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/085,625, filed Nov. 21, 2006, 13 pages.
Y. Terao et al., Notice of Allowance and Fee(s) Due, U.S. Appl. No. 11/008,257, filed Oct. 24, 2006, 11 pgs.
C. Iizuka et al., U.S. PTO Office, U.S. Appl. No. 11/085,251, Oct. 16, 2007, 10 pages.
Y. Terao et al., Notice of Allowance and Fee(s) Due, U.S. Appl. No. 11/085,242, Nov. 7, 2007, 10 pages.
Y. Terao et al., Notice of Allowance and Fee(s) Due, U.S. Appl. No. 11/085,257, Oct. 31, 2007, 8 pages.
Y. Terao et al., U.S. PTO Office, U.S. Appl. No. 11/085,250 Nov. 20, 2007, 13 pages.
Y. Terao et al., U.S. PTO Office, U.S. Appl. No. 11/085,625 Nov. 2, 2007, 11 pages.

* cited by examiner

SHEET FINISHING APPARATUS

BACKGROUND OF THE INVENTION

1. Field of the Invention

The present invention relates to a sheet finishing apparatus for post-processing sheets of paper ejected from an image forming apparatus such as a copier, a printer, or a composite device.

2. Description of the Related Art

In recent years, there has been an image forming apparatus used in which to perform a post process of sorting and stapling sheets of paper after image forming, a sheet finishing apparatus is installed adjacent to the paper ejection unit of the image forming apparatus body.

In Japanese Patent Publication No. 7-100563, a finisher having an online mode in which the image forming apparatus body and stapler are operated together and an offline mode in which the stapler is operated independently for performing the stapling process when the offline mode is selected is described. Further, there is a sheet finishing apparatus having a switching member, depending on a case requiring the post process or a case requiring no post process, for conveying sheets of paper to a separate conveying path.

However, in such a post processing apparatus, the so-called paper jamming, that is, jamming of sheets of paper in the conveying path may occur and it is not easy for a user to release the paper jamming.

DETAILED DESCRIPTION OF THE INVENTION

Throughout this description, the embodiments and examples shown should be considered as exemplars, rather than limitations on the apparatus of the present invention.

Hereinafter, the embodiment of the present invention will be explained in detail with reference to the accompanying drawings.

Figure 1:
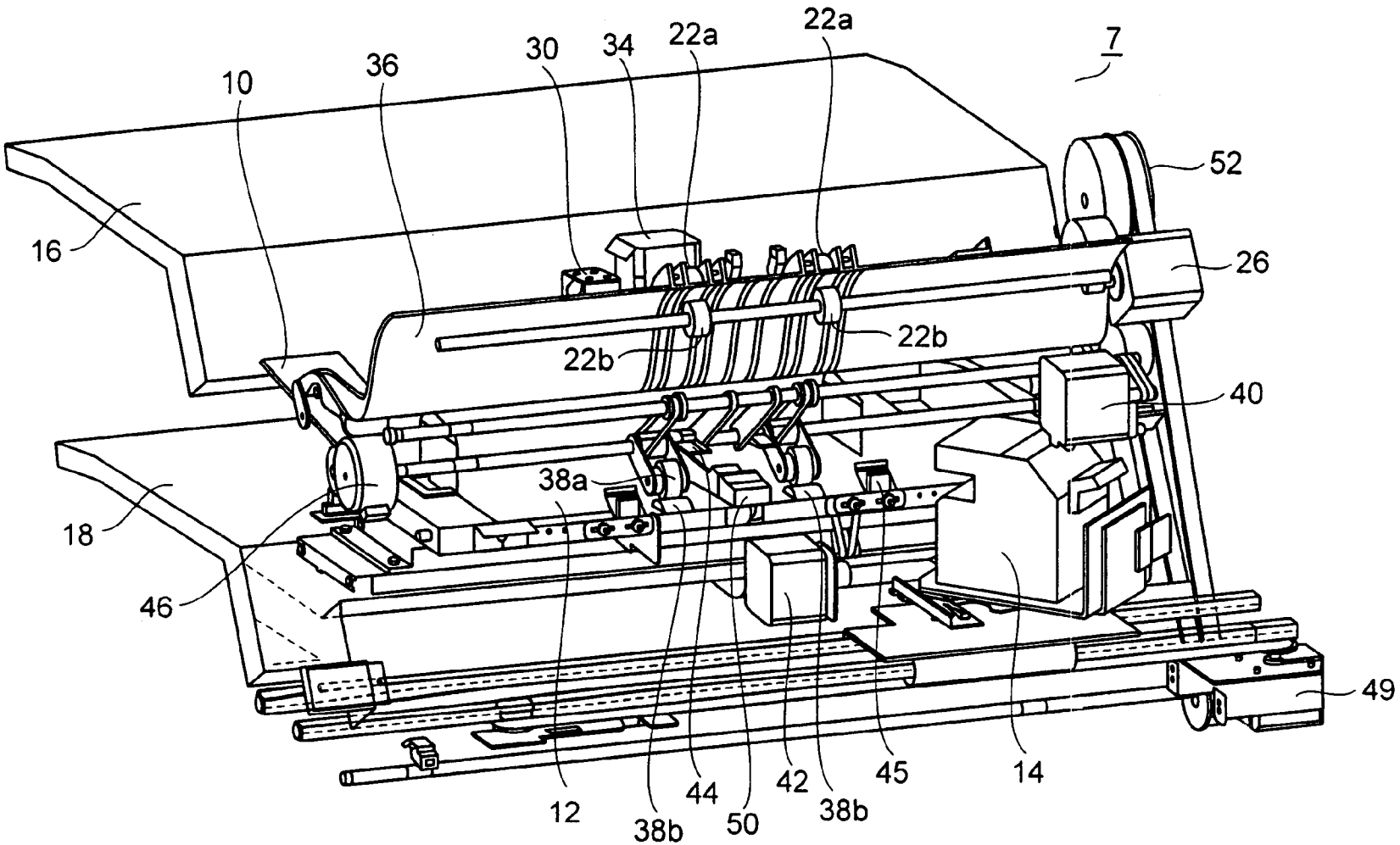
FIG. 1 is a perspective view showing the essential section of the sheet finishing apparatus relating to an embodiment of the present invention.
Figure 2:
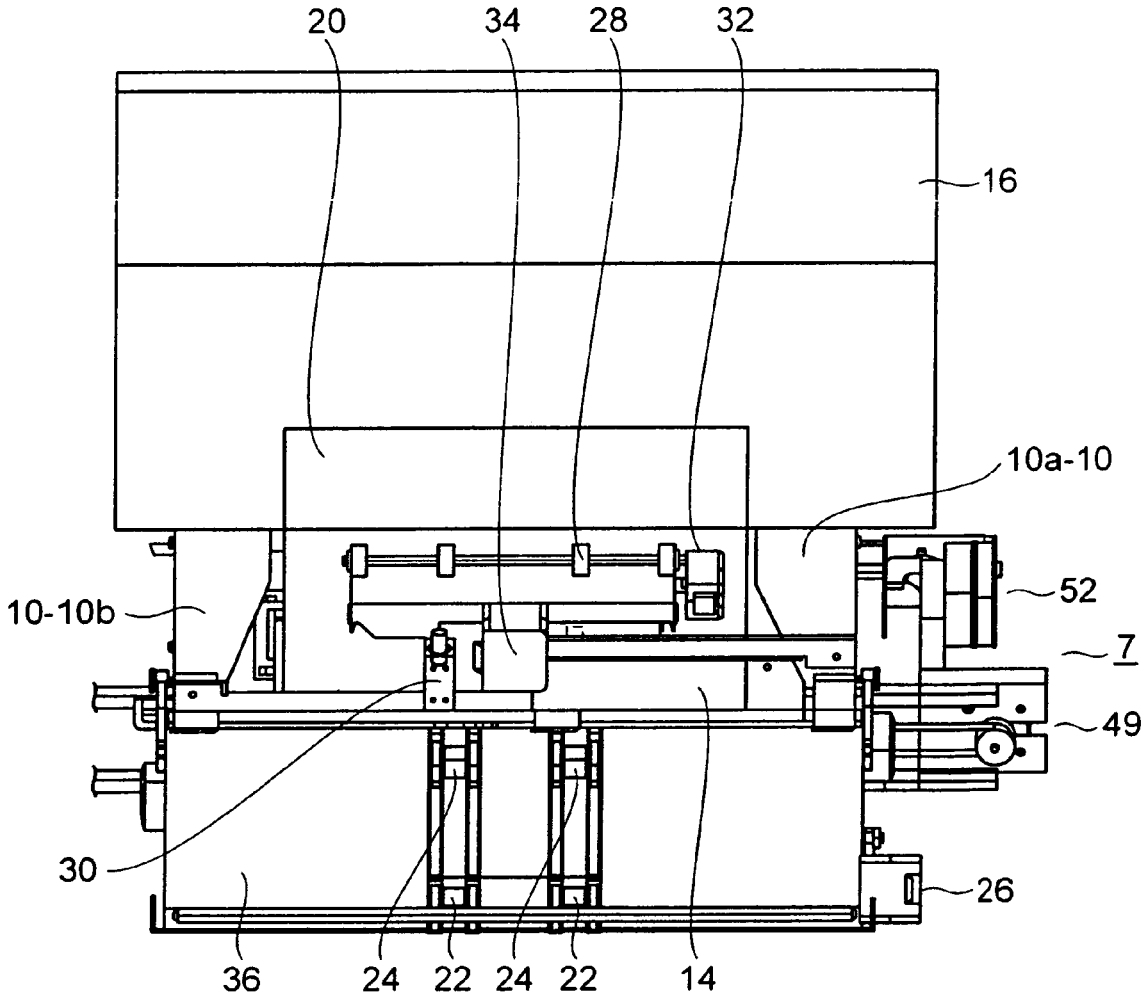
FIG. 2 is a top view showing the essential section of the sheet finishing apparatus relating to an embodiment of the present invention.
Figure 3:
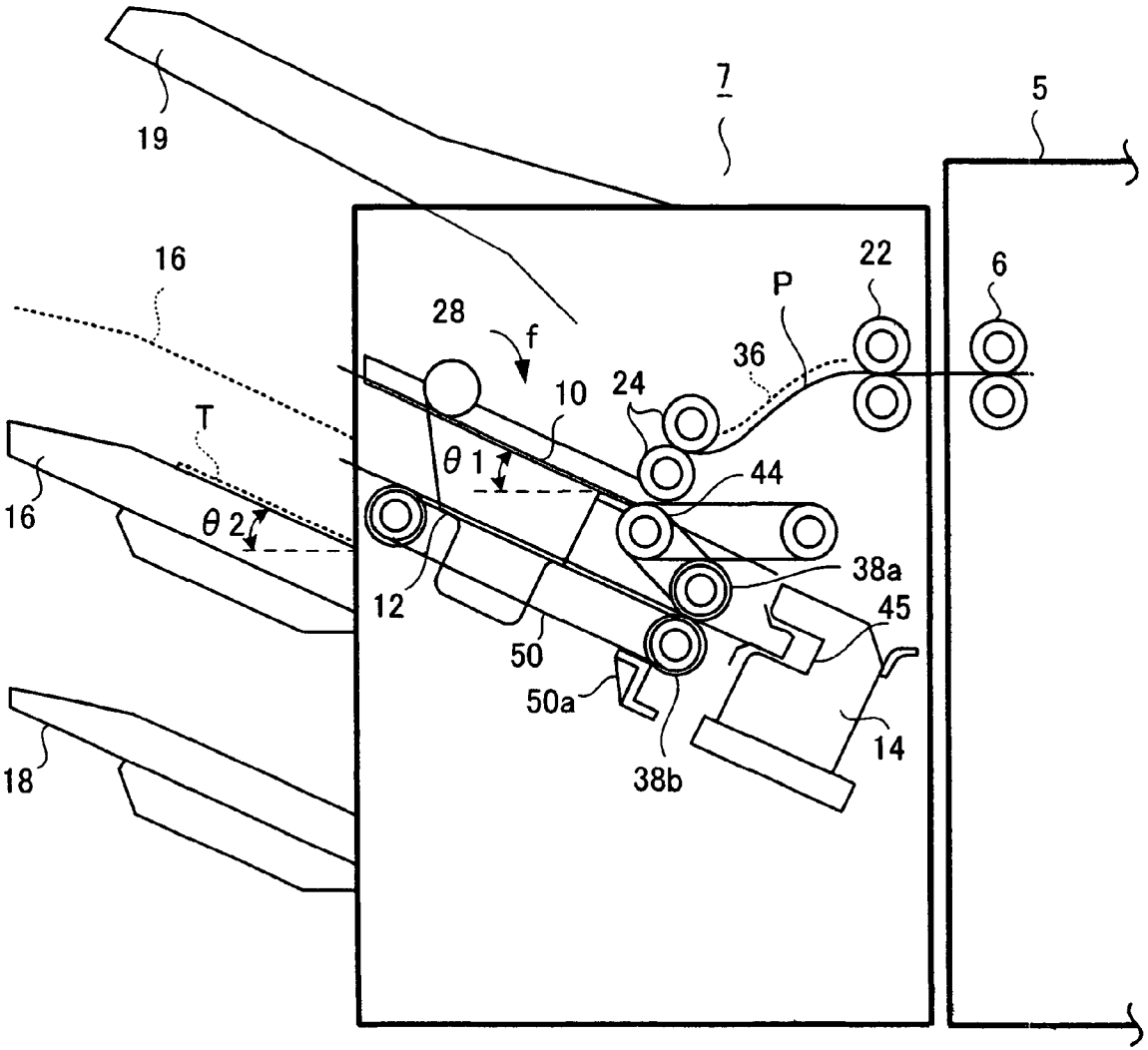
FIG. 3 is a schematic block diagram showing the sheet finishing apparatus relating to an embodiment of the present invention.

Further, in each drawing, to the same parts, the same numerals are assigned and duplicated explanation will be omitted. FIG. 1 is a perspective view showing the essential section of a sheet finishing apparatus 7 relating to an embodiment of the present invention, and FIG. 2 is a top view showing the essential section of the sheet finishing apparatus relating to an embodiment of the present invention, and FIG. 3 is a schematic block diagram showing the sheet finishing apparatus 7 arranged adjacent to an image forming apparatus 5 such as a copier.

The sheet finishing apparatus 7 basically has a standby tray 10, a processing tray 12, a stapler 14, a first paper ejection tray 16, a second paper ejection tray 18, a fixing tray 19, and a gate G.

A sheet of paper P, which an image is formed thereon by the image forming apparatus 5 such as a copier and ejected from a pair of paper ejection rollers 6, is received by a pair of inlet rollers 22 installed in the neighborhood of the taking-in port. The inlet rollers 22 are composed of an upper inlet roller 22*a* and a lower inlet roller 22*b*. The inlet rollers 22 are driven by an inlet roller motor 26.

Figure 12:
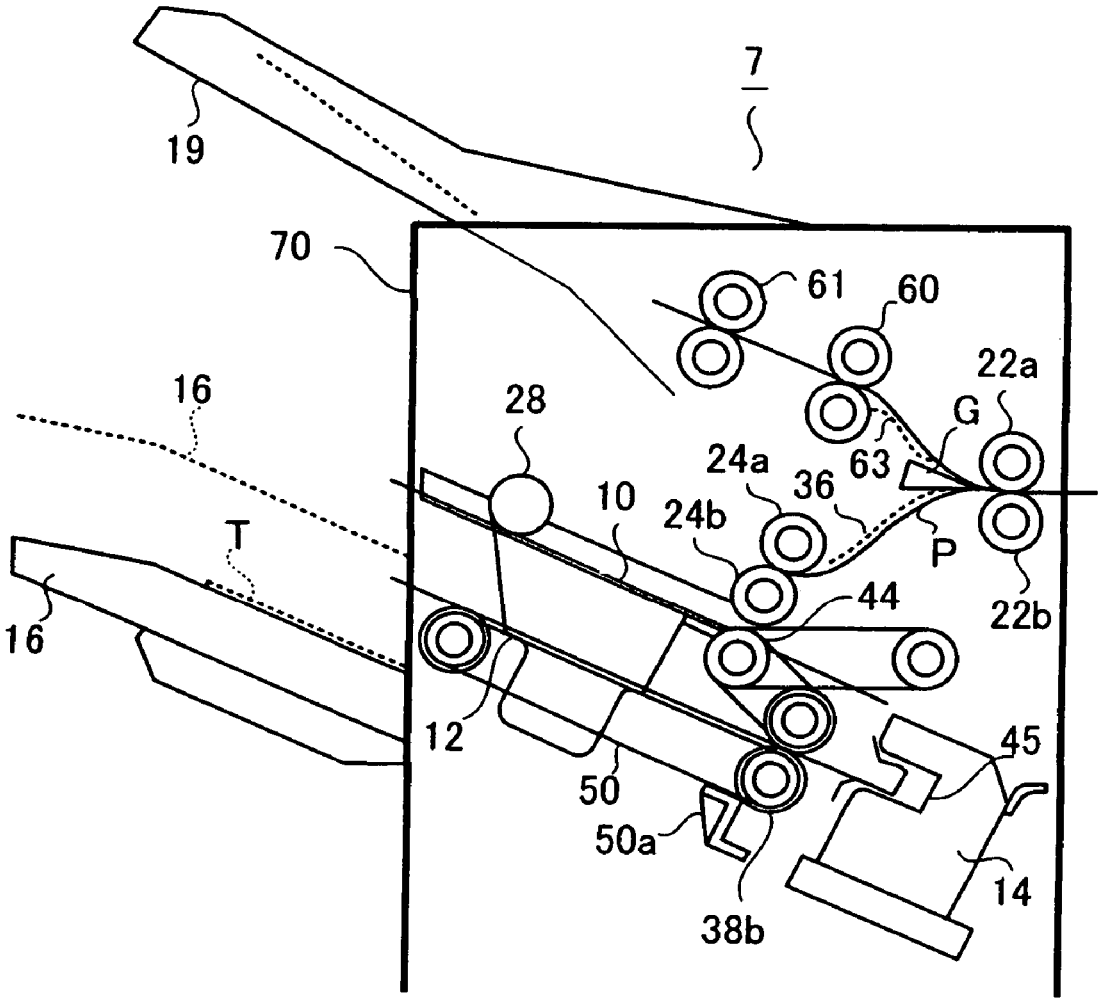
FIG. 12 is a schematic block diagram for explaining the conveying path of sheets of paper relating to an embodiment of the present invention.

As shown in FIG. 12, on the downstream side of the inlet rollers 22, the gate G for branching the sheet of paper P received by the inlet rollers 22 to two paths (flows) is installed. The gate G has a sectional shape of a wedge and the pointed part of the wedge is directed toward the neighborhood of the rotating surfaces of the inlet rollers 22. The gate G is rotatably born by the inner side wall of the sheet finishing apparatus 7. The pointed part of the wedge is set to the first position pointing towards the upper inlet roller 22*a* and the second position pointing towards the lower inlet roller 22*b*.

Namely, the first position is used to select the path when sheets of paper P require the post process and the second position is used to select the path when sheets of paper P do not require the post process.

When the gate G is set in the first position, sheets of paper P are supplied to the first paper supply rollers 24 and are sent to the standby tray 10 from the paper supply rollers 24. Between the inlet rollers 22 and the standby tray 10, a paper path ceiling 36 for leading sheets of paper P to the first paper supply rollers 24 is installed. The first paper supply rollers 24 are composed of an upper paper supply roller 24*a* and a lower paper supply roller 24*b*.

Under the standby tray 10, the processing tray 12 for loading sheets of paper P dropped and supplied from the standby tray 10 is arranged.

Figure 7:
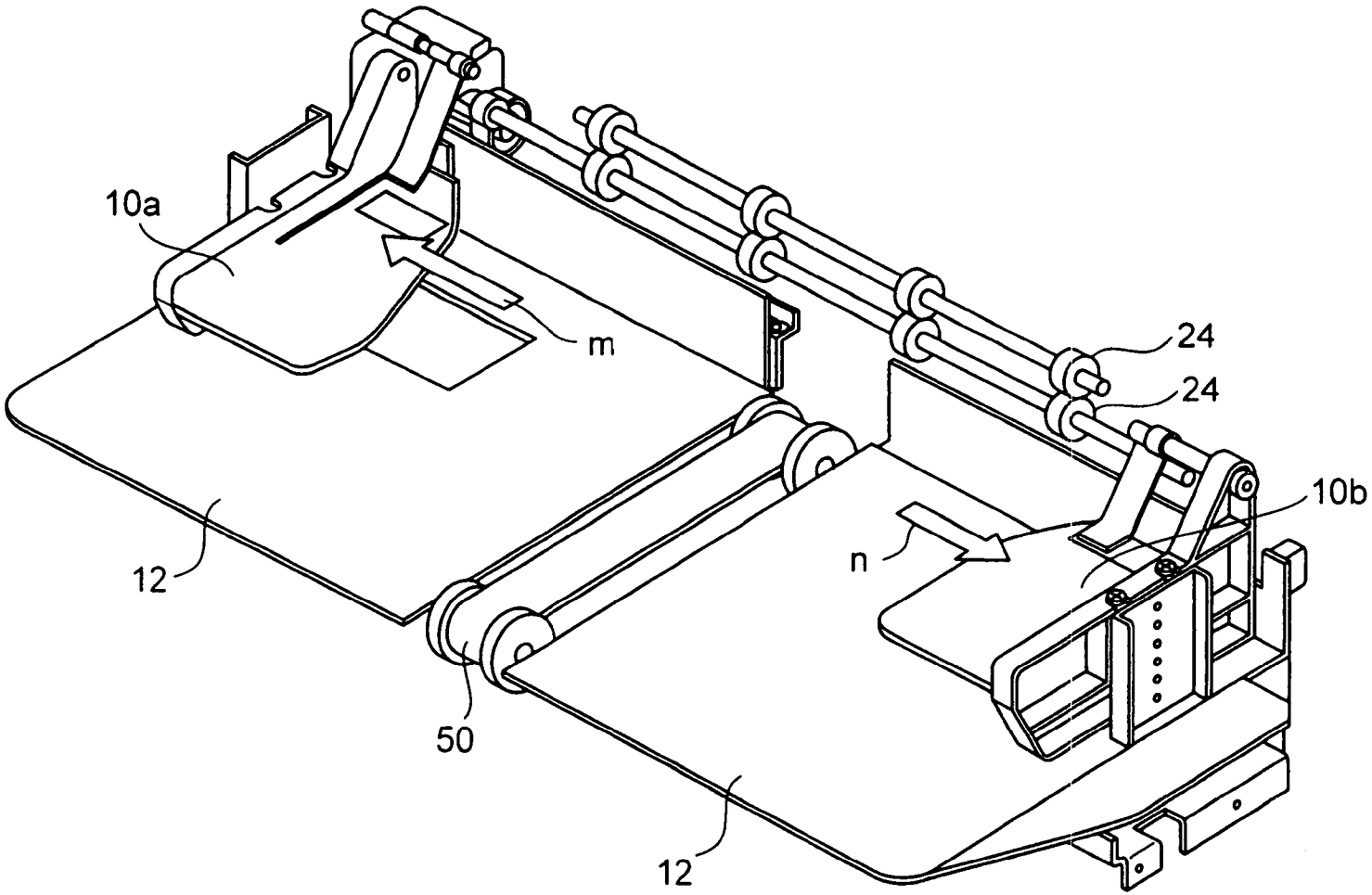
FIG. 7 is a schematic perspective view showing the standby tray and processing tray relating to an embodiment of the present invention.

The processing tray 12, while sheets of paper P are stapled by the stapler 14 which is a processing mechanism for performing the post process, matches and supports the sheets of paper P to be loaded. As shown in FIG. 7, when a predetermined number of sheets of paper is stored in the standby tray 10, standby tray parts 10*a* and 10*b* are opened in the horizontal direction in the drawing by a standby tray motor 34 and the sheets of paper P are dropped on the processing tray 12 by their own weight.

Figure 4:
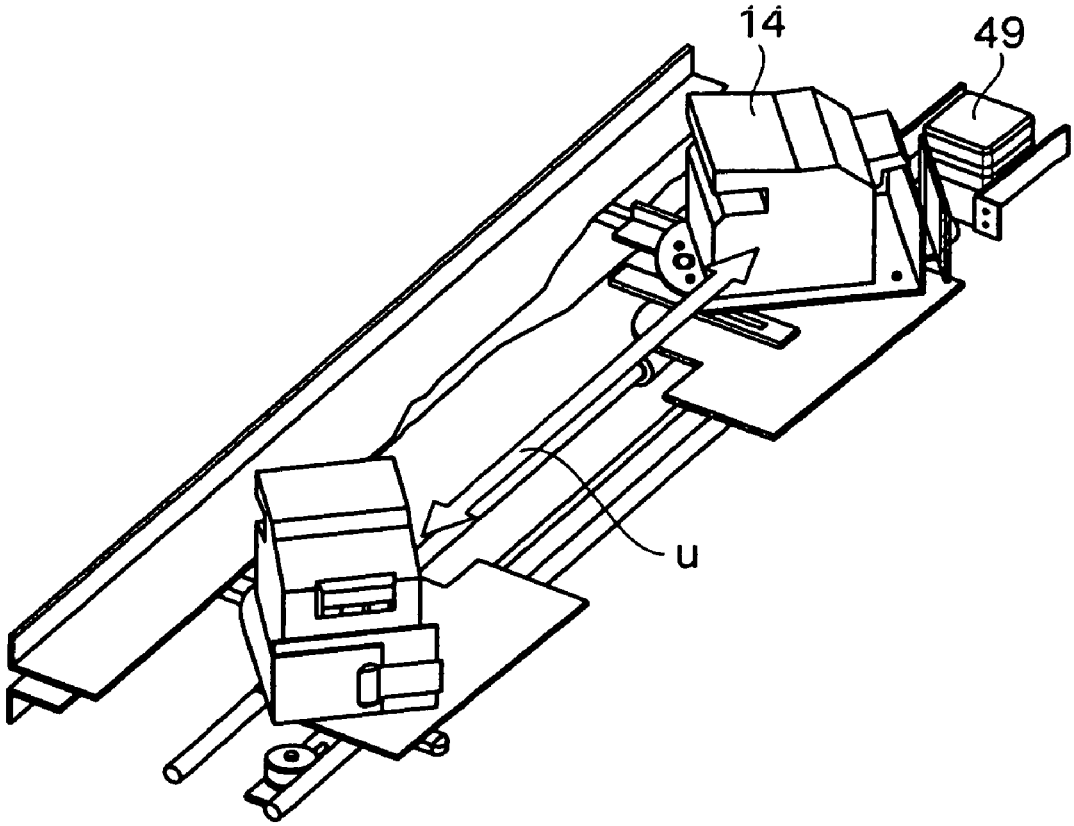
FIG. 4 is a perspective view showing the stapler of the sheet finishing apparatus relating to an embodiment of the present invention.

As shown in FIG. 4, the stapler 14 is slidden and positioned in the direction u by a stapler driving unit 49 and staples sheets of paper. The processing tray 12, to match a plurality of sheets of paper P dropped and supplied from the standby tray 10 in the vertical direction which is the conveying direction, has a pair of upper vertical matching roller 38*a* and lower vertical matching roller 38*b* shown in FIG. 5. The upper and lower vertical matching rollers 38*a* and 38*b* serve as bundle conveying rollers for clamping a sheet bundle T after the end of the stapling process and taking it out from the stapler 14. The upper vertical matching roller 38*a* is driven by a vertical matching upper roller motor 40 and the lower vertical matching roller 38*b* is driven by a vertical matching lower roller motor 42.

Figure 6:
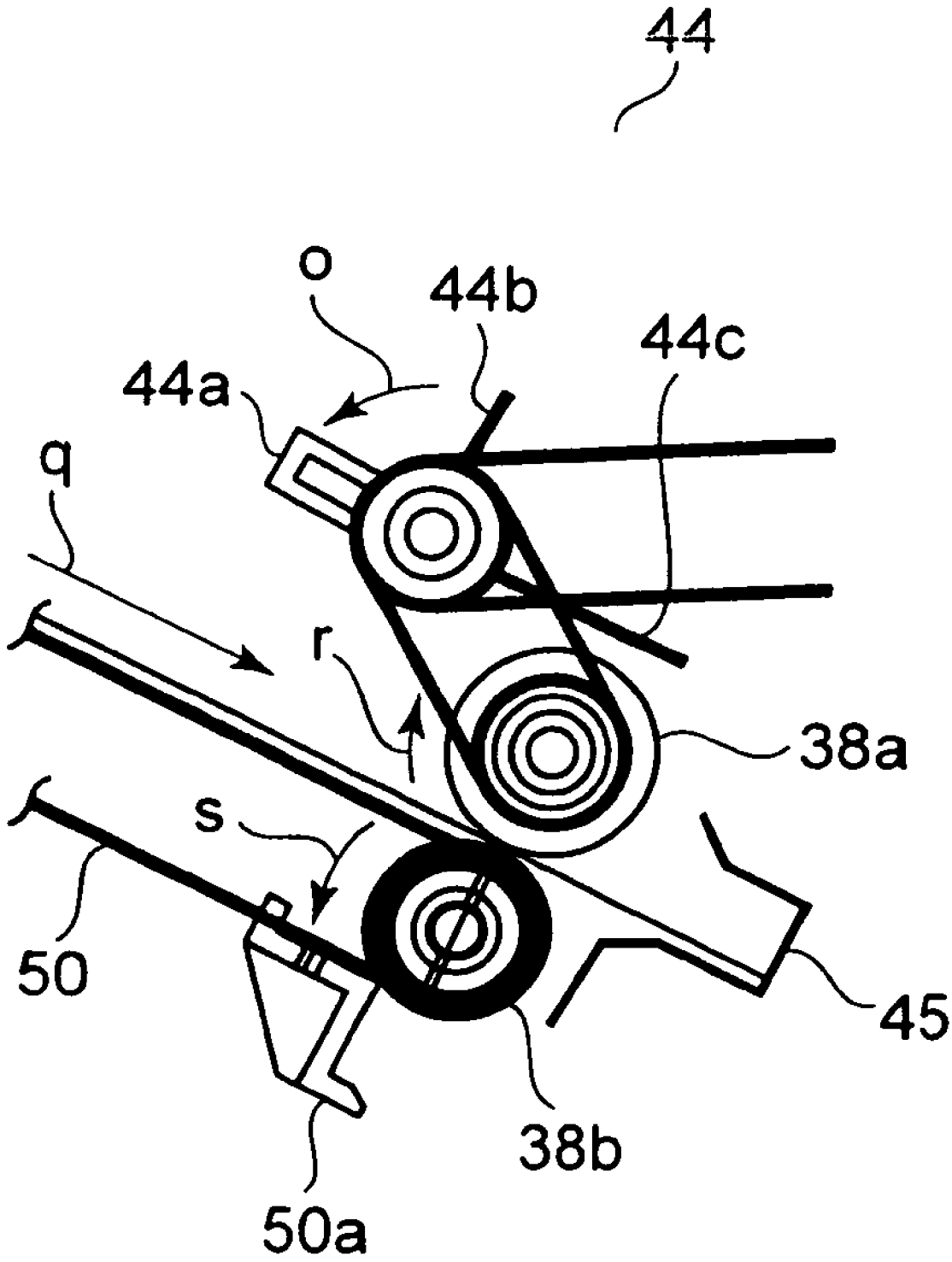
FIG. 6 is an illustration showing the paddle relating to an embodiment of the present invention.

Further, when sheets of paper P are dropped and supplied onto the processing tray 12, at the position where the rear end of each sheet of paper P is dropped, a paddle 44 rotatable for matching the uppermost sheet of paper P loaded on the processing tray 12 in the vertical direction is arranged. The paddle 44, as shown in FIG. 6, has a receiver 44*a* for receiving sheets of paper P dropped and supplied onto the processing tray 12, a tapping portion 44*b* for tapping down sheets of paper P onto the processing tray 12, and a feeder 44*c* for matching sheets of paper P on the processing tray 12 and is driven by a paddle motor 46. The paddle 44 is made of rubber and is elastic.

At the end of the processing tray 12 on the side of the stapler 14, a stopper 45 for making contact with the rear end of each sheet of paper P and controlling the rear end position is installed. Almost at the center of the processing tray 12, a conveying belt 50 for conveying a sheet bundle T which is stapled and taken out from the stapler 14 by the upper and lower vertical matching rollers 38*a* and 38*b* to the first or second paper ejection tray 16 or 18 is installed. To the conveying belt 50, a feeding pawl 50*a* for catching the rear end of the sheet bundle T is attached.

The standby tray 10 can drop and supply sheets of paper P to the processing tray 12 and also can convey the sheets of paper P toward the first or second paper ejection tray 16 or 18 and conveying the sheets of paper P toward the paper ejection trays 16 and 18 is executed by a standby tray roller 28 for matching sheets of paper P making contact with the sheets of paper P on the standby tray 10. The standby tray roller 28 is controlled to move up and down by a standby tray roller driving source 30 and is driven to rotate by a standby tray roller motor 32.

The standby tray 10 is arranged at an angle of inclination of θ1 so as to support sheets of paper P in a state that the front end of each sheet of paper P is positioned higher than the rear end thereof. The first or second paper ejection tray 16 or 18 is moved up and down by a paper ejection tray driving unit 52 and either of them is selected. The first or second paper ejection tray 16 or 18, when loading sheets of paper P, is moved up or down at an almost same height as that of the standby tray 10 or the processing tray 12 so as to improve the consistency of the position of sheets of paper P ejected. Further, the first or second paper ejection tray 16 or 18 is arranged at an angle of inclination of θ2 so as to support sheets of paper P in a state that the front end of each sheet of paper P is positioned higher than the rear end thereof.

Figure 8:
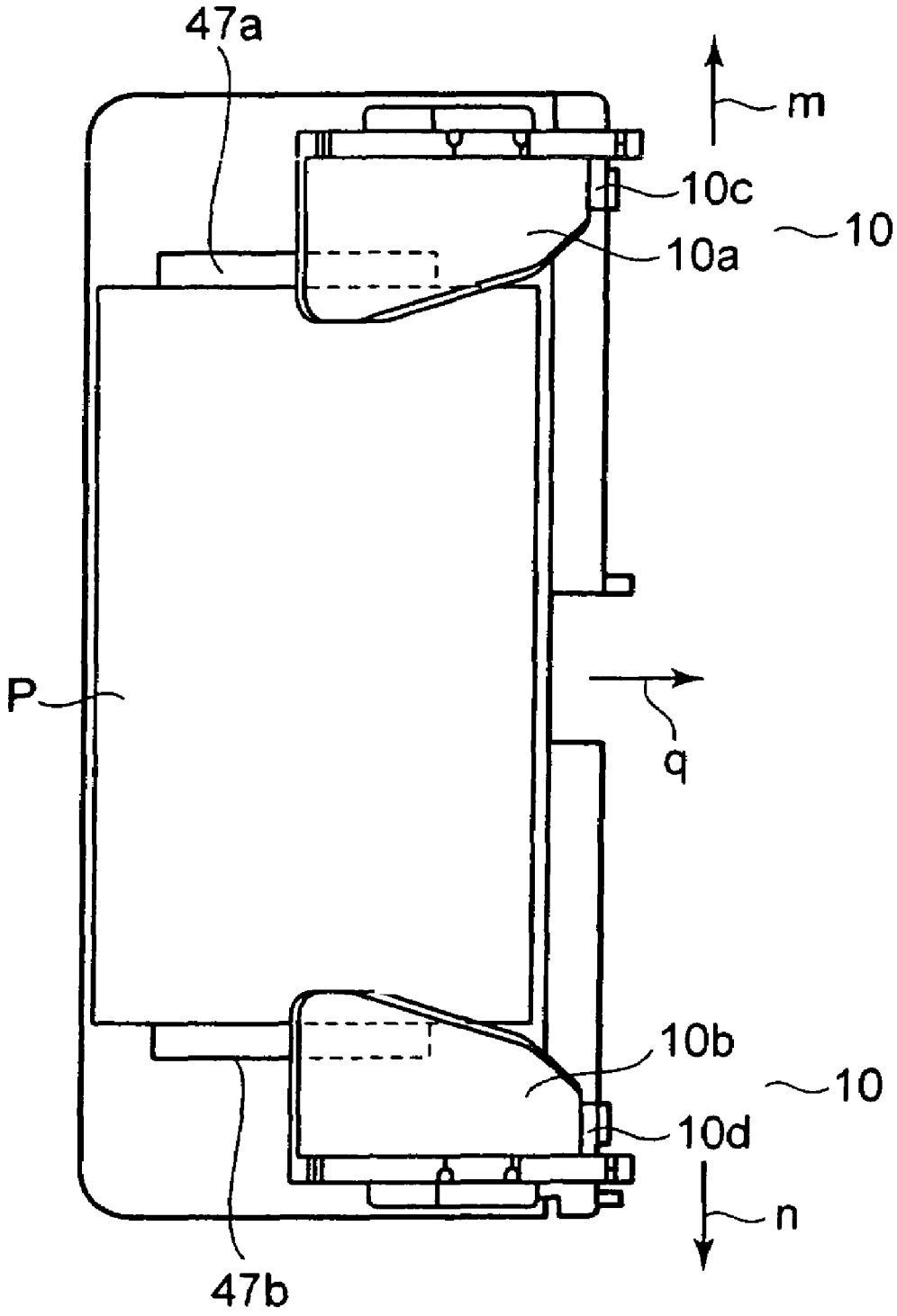
FIG. 8 is a top view showing the standby tray and processing tray relating to an embodiment of the present invention.

As shown in FIGS. 7 and 8, the standby tray 10 has the pair of tray members 10*a* and 10*b* formed so as to project from the wall surface thereof, receives each sheet of paper P by sliding in accordance with the width of the sheet of paper P, and supports both sides of the sheet of paper P. On the tray members 10*a* and 10*b*, standby stoppers 10*c* and 10*d* for controlling the rear end of each sheet of paper P are installed.

Figure 9:
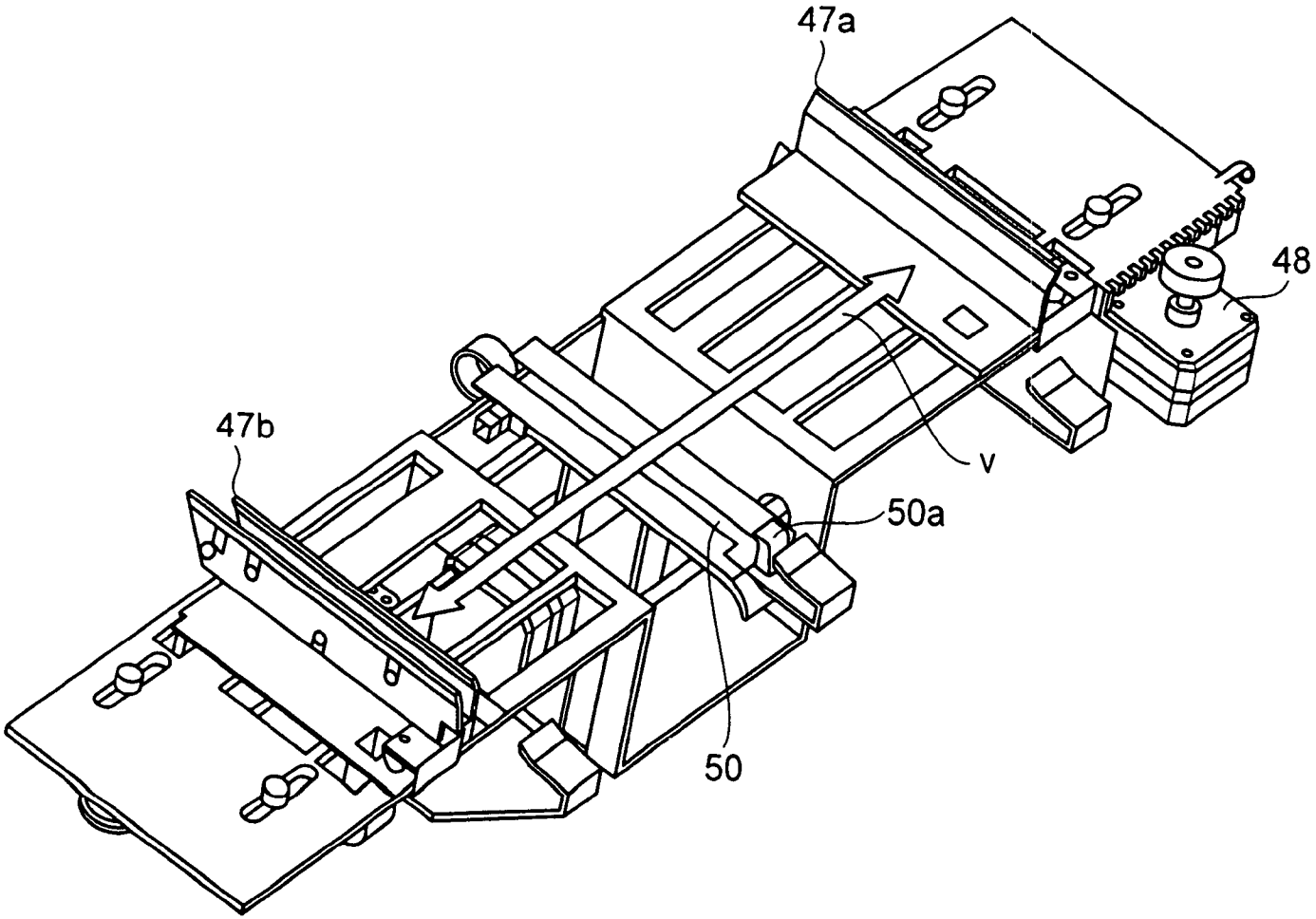
FIG. 9 is a schematic perspective view showing the horizontal matching plate and conveying belt relating to an embodiment of the present invention.

The standby tray 10 is slidden and moved by the standby tray motor 34. Between the standby tray 10 and the processing tray 12, when dropping and supplying sheets of paper P from the standby tray 10 onto the processing tray 12, horizontal matching plates 47*a* and 47*b*, shown in FIG. 9, for horizontally matching the sheets of paper P to prevent them from being disordered in the horizontal direction perpendicular to the conveying direction are installed. The horizontal matching plates 47*a* and 47*b* are formed so as to slide in the direction v in accordance with the width of the sheets of paper P by a horizontal matching motor 48.

When the gate G is at the second position as shown in FIG. 12, sheets of paper P requiring no post process are supplied to second paper supply rollers 60 and moreover supplied to third paper supply rollers 61. The second paper supply rollers 60 and the third paper supply rollers 61 are respectively composed of an upper paper supply roller and a lower paper supply roller.

A paper path 63 for leading sheets of paper P branching at the gate G from the inlet rollers 22 to the second paper supply rollers is installed. Further, between the second paper supply rollers 60 and the third paper supply rollers 61, another paper path may be installed. The reason is that sheets of paper P can be conveyed surely.

Furthermore, the sheets of paper P conveyed from the third paper supply rollers 61 are sent to the fixing tray 19 installed on the top of the sheet finishing apparatus 7. The fixing tray 19 is attached switchably to the top of the body 70 of the sheet finishing apparatus 7.

Figure 13:
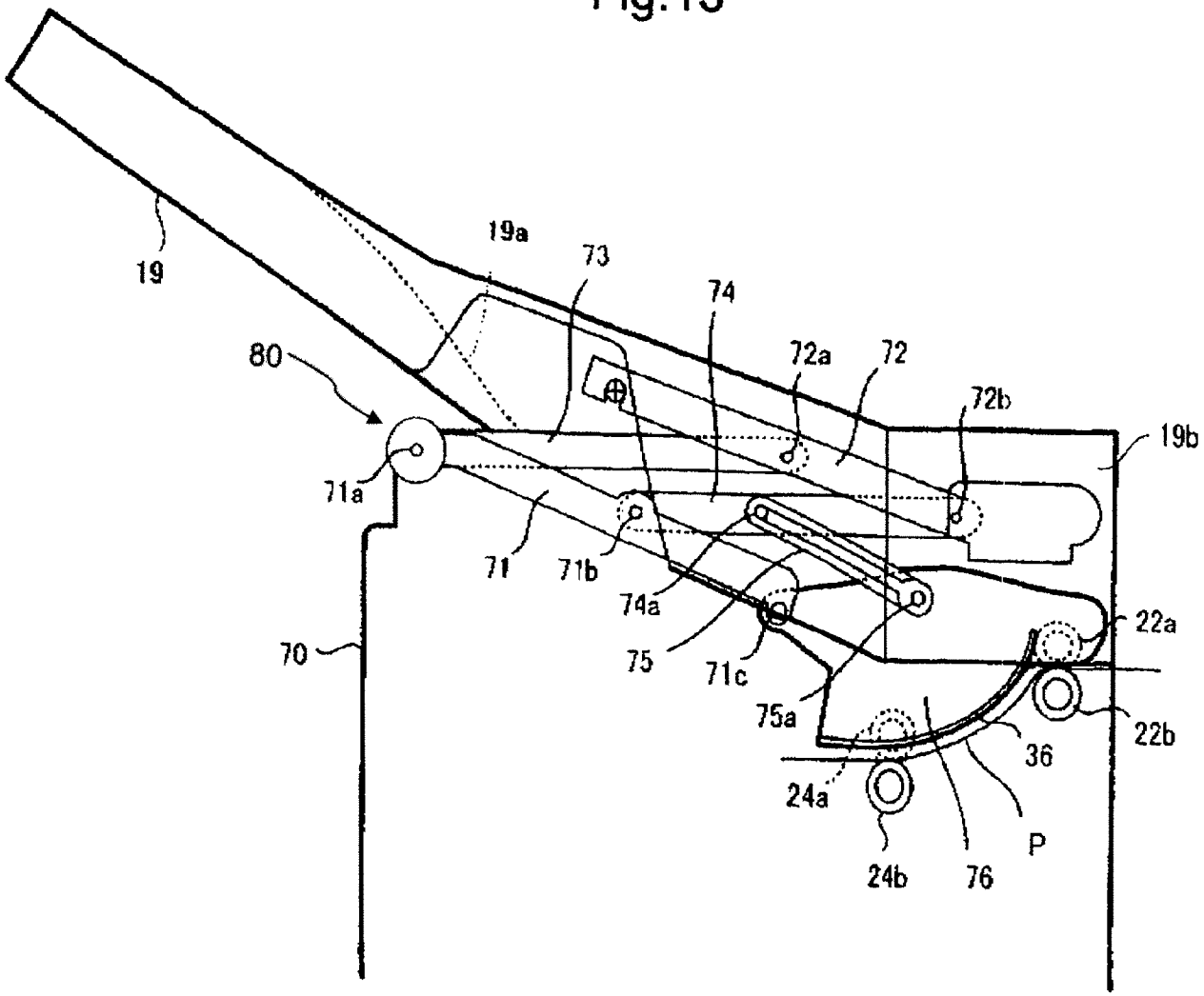
FIG. 13 is an illustration for explaining the jam processing mechanism relating to an embodiment of the present invention.

FIG. 13 shows the jam processing mechanism mainly including the switching structure of the fixing tray 19. In FIG. 13, the fixing tray 19 has a bottom 19*a* for receiving ejected sheets of paper and a side wall 19*b* and to the top of the body 70 on the opposite side of the sheet taking-in side, a first fixing member 71 is attached slantwise. Further, to the side wall 19*b* of the fixing tray 19, a second fixing member 72 is attached slantwise.

Between an upper end 71*a* of the first fixing member 71 and an intermediate part 72*a* of the second fixing member 72, a first link member 73 is connected and between an intermediate part 71*b* of the first fixing member 71 and a lower end 72*b* of the second fixing member 72, a second link member 74 is connected. The first and second link members 73 and 74 form parallel links and are arranged at a predetermined interval in parallel attached to the first fixing member 71 and the second fixing member 72.

Further, to an intermediate part 74*a* of the link member 74, one end of a connection link 75 is connected rotatably and another end 75*a* of the connection link 75 is connected rotatably to a sheet guidance member 76. To the sheet guidance member 76, the paper path ceiling 36 is attached and is supported rotatably by a lower end 71*c* of the first fixing member 71.

The first link member 73 rotates at the fulcrums of 71*a* and 72*a* and the second link member 74 rotates at the fulcrums of 71*b* and 72*b*. Further, the connection link 75 rotates at the fulcrums of 74*a* and 75*a* and the sheet guidance member 76 rotates at the fulcrum of 71*c*. Further, by the sheet guidance member 76, the upper inlet roller 22*a* of the pair of inlet rollers 22 and the upper paper supply roller 24*a* of the pair of paper supply rollers 24 are supported.

Further, the motors 26, 34, 40, 42, 46, and 48 for driving various mechanisms aforementioned and the driving units 49 and 52 are driven and controlled by a control circuit (not drawn).

Next, the operation of the invention will be described. When an image is formed by the image forming apparatus 5 and a sheet of paper P is supplied from the paper ejection rollers 6, the sheet finishing apparatus 7 performs a different operation depending on execution of the post process of the sheet of paper P or no execution thereof, or during execution of the post process of the preceding sheet of paper P or end of the post process.

When the post process is not performed, the pointed part of the wedge of the gate G is at the second position pointing towards the lower inlet roller 22*b*. The sheet of paper P supplied from the inlet rollers 22 is supplied to the second paper supply rollers 60 and then supplied to the third paper supply rollers 61. The sheet of paper P taken out from the third paper supply roller is ejected to the fixing tray 19 on the top.

Next, a case that the stapling process which is the post process is to be performed and there is no preceding sheet of paper P during execution of the stapling process on the processing tray 12 will be described. At this time, the standby tray 10 slides and moves the tray members 10*a* and 10*b* respectively up to the positions indicated by the dotted lines shown in FIG. 11 in the direction of the arrow m and the direction of the arrow n and opens the drop and supply path of sheets of paper P. Further, the horizontal matching plates 47*a* and 47*b*, to horizontally match sheets of paper P dropped from the paper supply rollers 24, are arranged so that the interval between the horizontal matching plates 47*a* and 47*b* becomes almost equal to the width of the sheets of paper P. By doing this, the sheets of paper P supplied from the paper supply rollers 24 are directly dropped and supplied onto the processing tray 12 unless the conveyance is interrupted by the standby tray 10.

At the time of drop and supply, the upper vertical matching roller 38*a* is shifted upward and the receiver 44*a* of the paddle 44 receives the rear end of each sheet of paper P. The sheet of paper P drops in a state that both sides thereof are in contact with the horizontal matching plates 47*a* and 47*b* and is matched horizontally. Then, the paddle 44 rotates in the direction of the arrow o shown in FIG. 6 and the rear end of the sheet of paper P drops from the receiver 44*a* and is tapped down on to the processing tray 12 by the tapping portion 44*b*. Furthermore, the paddle 44 sends the sheet of paper P in the direction of the arrow q by the feeder 44*c*, and the rear end of the sheet of paper P makes contact with the stopper 45, and the matching of the sheet of paper P in the vertical direction is completed. Further, the vertical matching of sheets of paper P on the processing tray 12 may be executed by the upper vertical matching roller 38*a* by moving it up and down each time.

In this way, the sheets of paper P with an image formed thereon are sequentially matched in the horizontal direction and vertical direction and are loaded directly on the processing tray 12 from the paper supply rollers 24. When the sheets of paper Preach a predetermined number of sheets, the stapler 14 staples and bundles the sheets of paper P on the processing tray 12 at a desired position to form a sheet bundle T. Hereafter, as shown in FIG. 6, the sheet bundle T is clamped by the upper vertical matching roller 38*a* rotating in the direction of the arrow r and the lower vertical matching roller 38*b* rotating in the direction of the arrow s and is conveyed to the first paper ejection tray 16.

Figure 5:
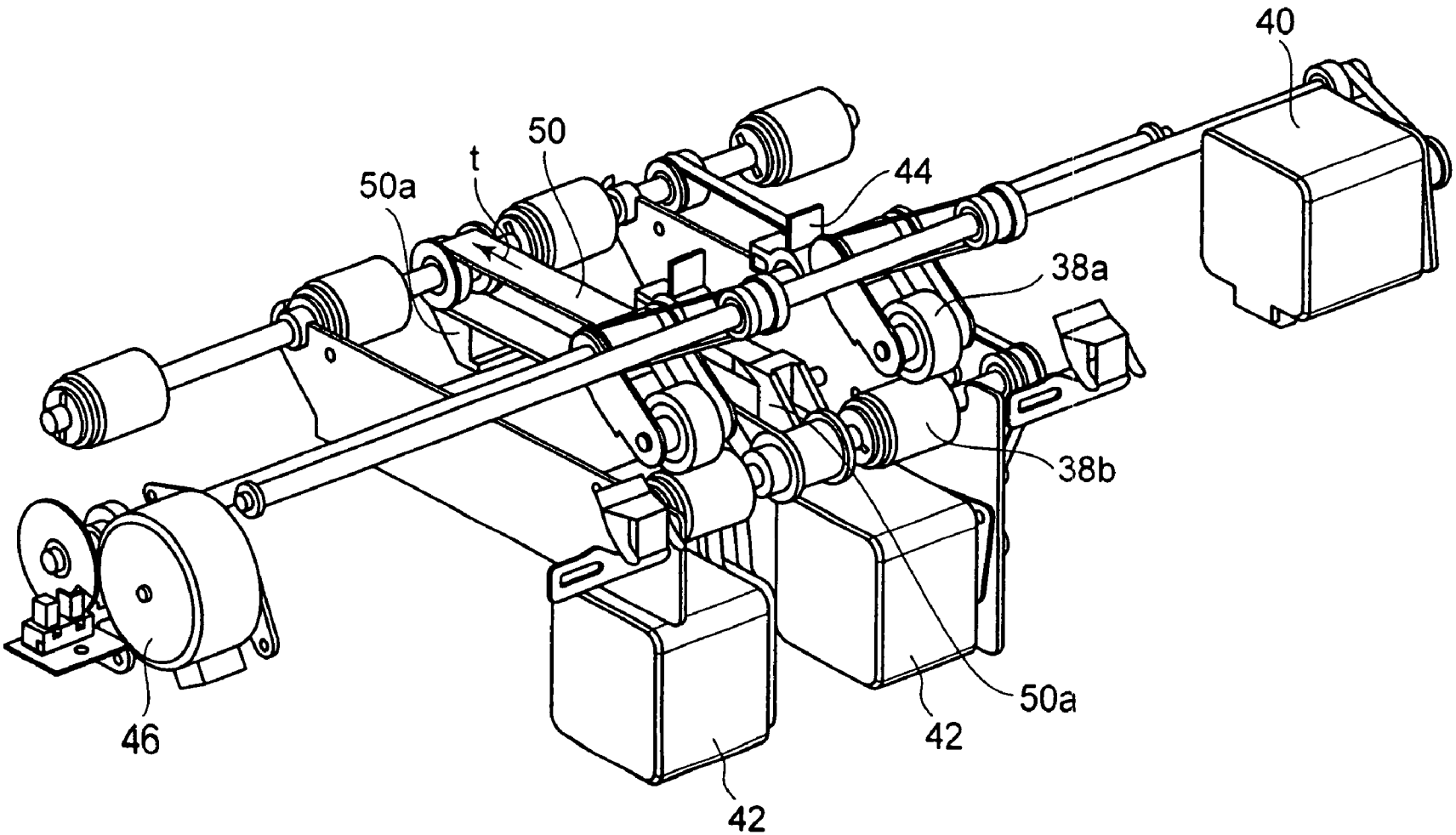
FIG. 5 is a perspective view showing the vertical matching roller relating to an embodiment of the present invention.

When the rear end of the sheet bundle T passes the upper and lower vertical matching rollers 38*a* and 38*b*, it is caught by the feeding pawl 50*a* of the conveying belt 50 rotating in the direction of the arrow t shown in FIG. 5 and the bundle is sent onto the first paper ejection tray 16. At this time, the first paper ejection tray 16 slides and moves from the position indicated by the dotted line in FIG. 3 to the position indicated by the solid line.

Further, the first paper ejection tray 16 is arranged at an angle of inclination of θ2 and the front end of each sheet of paper is positioned higher than the rear end thereof, so that the sheets of paper P of the bundle precedingly sent onto the first paper ejection tray 16 are not pressed out by contact with the front end of the succeeding sheet bundle T. Further, even if the preceding sheet bundle T is slightly shifted by the succeeding sheets of paper P, the angle of inclination θ2 is provided, so that the sheet bundle T drops by its own weight and is matched and loaded on the first paper ejection tray 16 in the state that the rear ends are properly arranged, and the stapling process of the sheets of paper P is completed.

Figure 10:
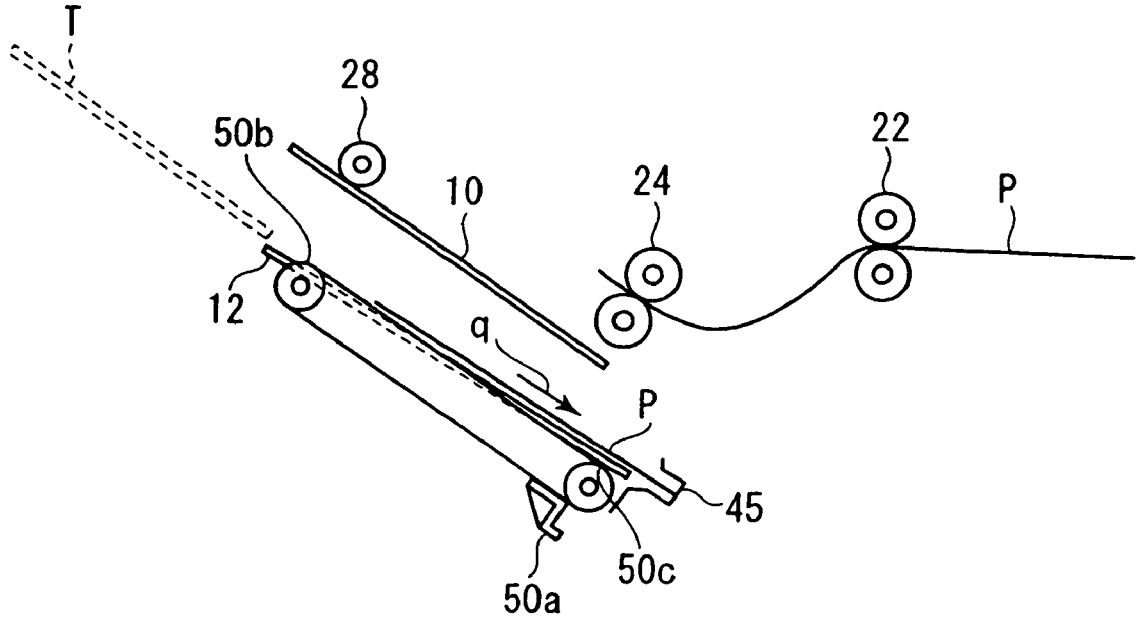
FIG. 10 is an illustration showing the condition that a sheet of paper on the standby tray or paper ejection tray relating to an embodiment of the present invention is pressed out.

In this way, sheets of paper are sequentially loaded on the first paper ejection tray 16. Further, the first paper ejection tray 16 is arranged at an angle of inclination of θ2 and the front end of each sheet of paper is positioned higher than the rear end thereof, so that for example, even if a sheet of paper P is ejected onto the first paper ejection tray 16 in a state that it is curved convexly as shown by the dotted line in FIG. 10, the sheet of paper P precedingly loaded on the paper ejection tray 16 is not pressed out by contact with the front end of the succeeding sheet of paper P. Namely, the ejected sheet of paper P is sequentially loaded on the first paper ejection tray 16 unless the order is disturbed.

Next, a case that the stapling process which is the post process is to be performed and a preceding sheet of paper P during execution of the stapling process remains on the processing tray 12 will be described. At this time, the standby tray 10 slides and moves the tray members 10*a* and 10*b* from the positions indicated by the dotted lines shown in FIG. 11 respectively in the opposite direction of the direction of the arrow m and the opposite direction of the direction of the arrow n and can support the sheets of paper P in the positions indicated by the solid lines shown in FIG. 11. Further, the standby tray roller 28 is shifted upward not to disturb the sheets of paper P. Sheets of paper P which are ejected from the image forming apparatus 5 and supplied by the paper supply rollers 24 are loaded once on the standby tray 10 to wait for the processing tray 12 to become empty.

The sheets of paper P loaded on the standby tray 10, by the standby tray roller 28 which drops on the standby tray 10 and rotates in the opposite direction of the direction of the arrow f shown in FIG. 3, are sent toward the standby stoppers 10*c* and 10*d* and are vertically matched in a state that the rear end of each sheet of paper P is in contact with the standby stoppers 10*c* and 10*d*. Furthermore, the standby tray 10 is arranged at an angle of inclination of θ1 and the front end of each sheet of paper is positioned higher than the rear end thereof, so that the rear end of each sheet of paper P makes contact with the standby stoppers 10*c* and 10*d* and the sheets of paper are vertically matched.

Further, the standby tray 10 is arranged at an angle of inclination of θ1, so that for example, even if a sheet of paper P is supplied from the paper supply rollers 24 in the state that it is curved convexly and supplied onto the standby tray 10, the sheet of paper P precedingly loaded on the standby tray 10 is not pressed out by contact with the front end of the succeeding sheet of paper P. Namely, the supplied sheet of paper P is sequentially loaded on the first paper ejection tray 16 unless the order is disturbed. Further, even if the preceding sheet of paper P is slightly shifted by being pressed by the succeeding sheet of paper P, the angle of inclination θ1 is provided, so that the sheet of paper P drops by its own weight down to the position where it makes contact with the standby stoppers 10*c* and 10*d* and is matched and loaded on the standby tray 10 in the state that the rear end is properly arranged.

Figure 11:
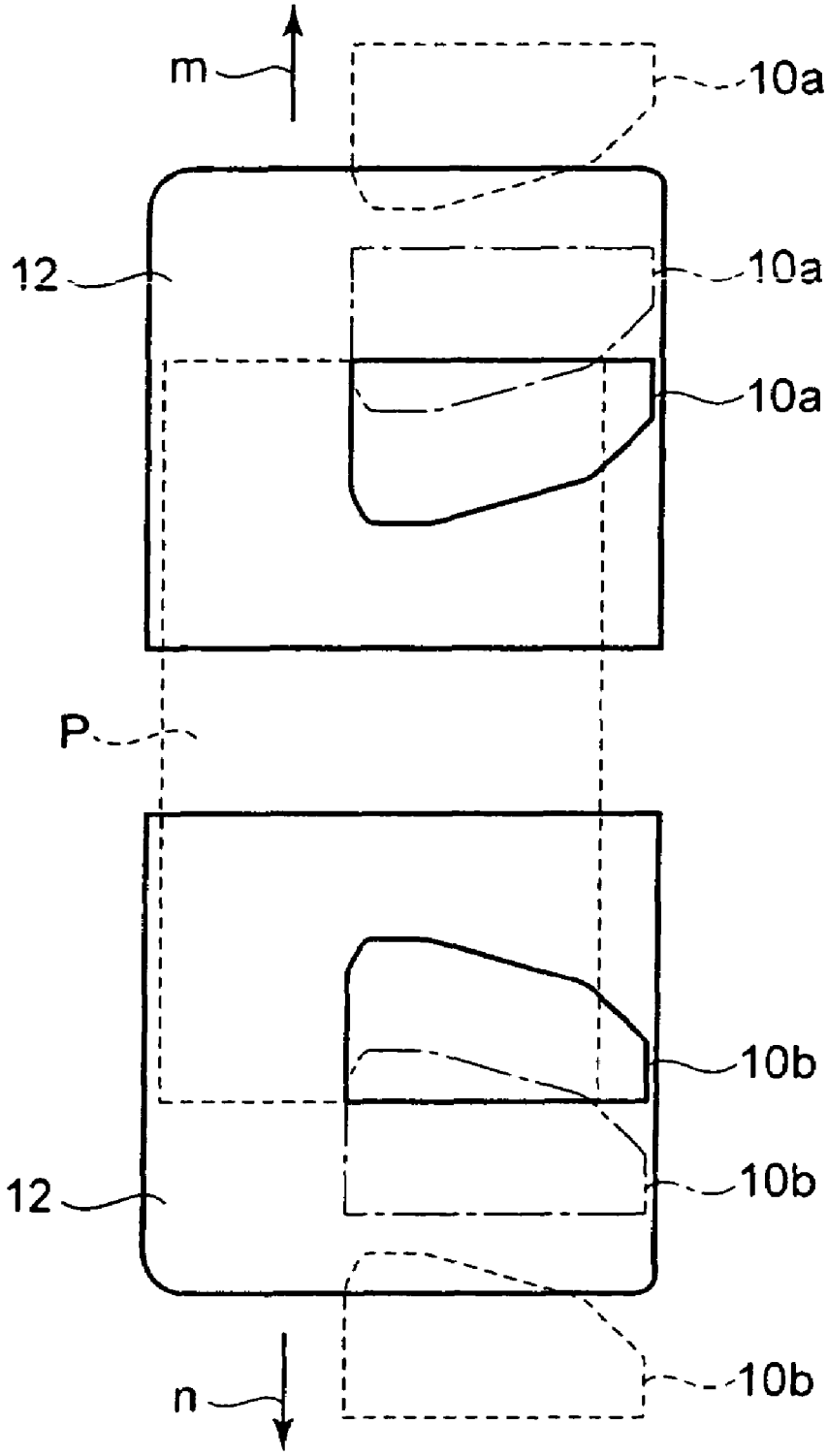
FIG. 11 is an illustration showing the movement of the standby tray relating to an embodiment of the present invention.

During this period, when the preceding sheet of paper P on the processing tray 12 is ejected on the side of the first paper ejection tray 16 and the processing tray 12 becomes empty, the standby tray 10 slides and moves the tray members 10*a* and 10*b* respectively in the direction of the arrow m and the direction of the arrow n from the positions indicated by the solid lines shown in FIG. 11 via the positions indicated by the alternate long and short dash lines shown in FIG. 11 up to the positions indicated by the dotted lines shown in FIG. 11. By doing this, for example, two sheets of paper P waiting on the standby tray 10, when the tray members 10*a* and 10*b* reach the positions indicated by the alternate long and short dash lines shown in FIG. 11, are dropped and supplied onto the processing tray 12 through the interval between the tray members 10*a* and 10*b*. At this time, the interval between the horizontal matching plates 47*a* and 47*b* is made almost equal to the width of the sheets of paper P. Therefore, the sheets of paper P dropped from the standby tray 10 are matched horizontally with both sides controlled by the horizontal matching plates 47*a* and 47*b*.

The lower side sheet of paper P of the two sheets of paper P dropped on the processing tray 12 is sent in the direction of the arrow q by the lower vertical matching roller 38*b* rotating in the opposite direction of the direction of the arrow s shown in FIG. 6, and the rear end of the sheet of paper P makes contact with the stopper 45, and the vertical matching of the sheet of paper P is completed. The upper side sheet of paper P of the two sheets of paper P dropped on the processing tray 12 is sent in the direction of the arrow q by the upper vertical matching roller 38*a* rotating in the opposite direction of the direction of the arrow r, and the rear end of the sheet of paper P makes contact with the stopper 45, and the vertical matching of the sheet of paper P is completed, and hereafter the upper vertical matching roller 38*a* is shifted upward.

The third and subsequent sheets of paper P ejected from the image forming apparatus 5 are directly dropped and supplied onto the processing tray 12 from the interval between the tray members 10*a* and 10*b* unless they wait on the standby tray 10. Hereafter, the third and subsequent sheets of paper P are sequentially matched on the sheets of paper P loaded on the processing tray 12 before the paddle 44.

When sheets of paper P loaded on the processing tray 12 reach a predetermined number of sheets, the sheets of paper P are stapled by the stapler 14 and a sheet bundle T is formed. Hereafter, the sheet bundle T is conveyed toward the first paper ejection tray 16 by the upper and lower vertical matching rollers 38*a* and 38*b*, and moreover the rear end thereof is caught by the feeding pawl 50*a* of the conveying belt 50, and the bundle is sent onto the first paper ejection tray 16, and the stapling process of the sheets of paper P is completed.

On the other hand, when the stapling process of sheets of paper is not required, the gate G shown in FIG. 12 is switched to the second position, and sheets of paper P conveyed from the image forming apparatus body 5 are supplied to the second paper supply rollers 60, then supplied to the third paper supply rollers 61, and are ejected to the fixing tray 19 on the top.

Figure 14:
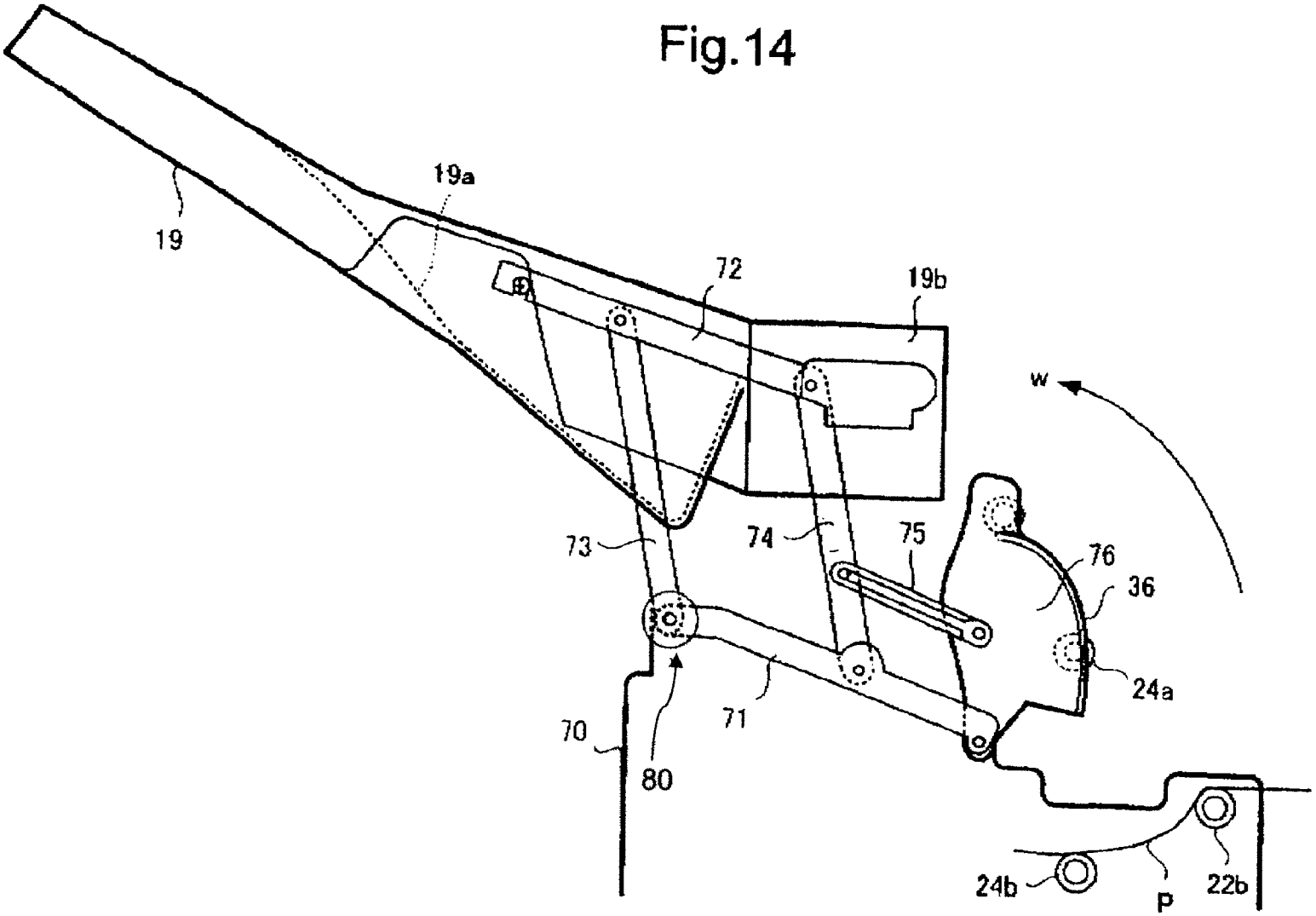
FIG. 14 is an illustration for explaining the operation of the jam processing mechanism relating to an embodiment of the present invention.

Next, a measure when paper jamming occurs in the conveying path of sheets of paper will be explained by referring to FIG. 14. FIG. 14 shows a condition that the fixing tray 19 is opened when jamming occurs. Namely, when jamming occurs, the fixing tray 19 can be opened in the direction of the arrow w shown in FIG. 14 from the closed condition (low height position) shown in FIG. 13, and the first and second link members 73 and 74 constituting the parallel links rotate almost vertically, and the fixing tray 10 moves upward. Further, in correspondence to the rotation of the second link member 74, the connection link 75 is pulled and the sheet guidance member 76 simultaneously rises vertically and is opened.

When the sheet guidance member 76 is opened, the upper inlet roller 22*a* and lower inlet roller 22*b* and the upper paper supply roller 24*a* and lower paper supply roller 24*b* are separated from each other, so that the conveying path of sheets of paper is exposed and even if a sheet of paper is jammed between the rollers 22 and 24, it can be taken out easily.

Further, by use of the parallel links 73 and 74, the fixing tray 19 rotates in the direction w and rises up to the high second height position, though even if this occurs, the angle of inclination of the fixing tray 19 is changed little. Therefore, even if there is already a sheet of paper ejected on the bottom 19*a*, it will not drop out though the fixing tray 19 is opened.

Further, to prevent the fixing tray 19 from a sudden open operation, a damper mechanism 80 is installed, as illustrated in FIGS. 13 and 14. Further, when the fixing tray 19 is closed, a lock mechanism is operated. However, when paper jamming occurs, the lock mechanism is released and the fixing tray 19 can be opened.

In this embodiment structured like this, when paper jamming occurs, a user only opens the fixing tray 19, thus he can easily remove the sheet of paper jammed. Therefore, the efficiency by the image forming apparatus is not reduced and a sheet finishing apparatus convenient for the user can be obtained.

Further, in the present invention, the post process performed for sheets of paper loaded on the processing tray is the stapling process. However, the post process is not limited to the stapling process and for example, the post process such as a hole punching (hole boring) process performed for sheets of paper is not questionable. In this case, one sheet of paper instead of a plurality of sheets of paper may be loaded unquestionably on the processing tray. Further, needless to say, for a post processing apparatus having such a post processing mechanism, the present invention produces an effect.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet finishing apparatus for post-processing sheets of paper after image forming, comprising:

a gate for taking in sheets of paper ejected from an image forming apparatus through a taking-in port and switching to either of a first conveying path for post processing or a second conveying path for non-post processing to convey said sheets of paper;

a tray attached to an upper part of said sheet finishing apparatus by a link mechanism which can rotate between a first height position for storing said sheets of paper ejected via said second conveying path and a second height position away from said upper part and has an angle of inclination substantially the same at either of said height positions;

a sheet guidance member for supporting rollers for clamping and conveying said sheets of paper passing said first conveying path and rotating between a first position where said one roller makes contact with another roller and a second position away from said another roller;

a connection member for connecting said link mechanism and said sheet guidance member so as to set said sheet guidance member at said first position when said tray is at said first height position and set said sheet guidance member at said second position when said tray is at said second height position, a processing mechanism for post-processing said sheets of paper conveyed via said first conveying path and an ejection mechanism for ejecting said sheets of paper post-processed by said processing mechanism, wherein said link mechanism has a first fixing member attached at an opposite position of said taking-in port on said upper part of said post processing apparatus body, a second fixing member attached to said tray, and a first and a second link member arranged in parallel at a predetermined interval so as to connect said first and second fixing members and wherein said first and second link members, when said tray is at said first height position, the link members are parallel with each other and substantially horizontal and when said tray is at said second height position, the link members are parallel with each other and substantially vertical.

2. The sheet finishing apparatus according to claim 1, wherein to avoid sudden rotation when said tray rotates from said first height position to said second height position, a damper mechanism is installed additionally.

3. A sheet finishing apparatus for post-processing sheets of paper after image forming, comprising:

a gate for taking in sheets of paper ejected from an image forming apparatus through a taking-in port and switching to either of a first conveying path for post processing or a second conveying path for non-post processing to convey said sheets of paper;

a tray attached to an upper part of said sheet finishing apparatus by a link mechanism which can rotate between a first height position for storing said sheets of paper ejected via said second conveying path and a second height position away from said upper part and has an angle of inclination substantially the same at either of said height positions;

a sheet guidance member for supporting rollers for clamping and conveying said sheets of paper passing said first conveying path and rotating between a first position where said one roller makes contact with another roller and a second position away from said another roller;

a connection member for connecting said link mechanism and said sheet guidance member so as to set said sheet guidance member at said first position when said tray is at said first height position and set said sheet guidance member at said second position when said tray is at said second height position, a processing mechanism for post-processing said sheets of paper conveyed via said first conveying path and an ejection mechanism for ejecting said sheets of paper post-processed by said processing mechanism, wherein said sheet guidance member can rotate at an end, as a fulcrum, on an opposite side of said taking-in port, and when said tray is at said first height position, is on a side of said another roller, and when said tray is at said second height position, rises substantially in a vertical direction.

4. The sheet finishing apparatus according to claim 3, wherein to avoid sudden rotation when said tray rotates from said first height position to said second height position, a damper mechanism is installed additionally.

5. A sheet finishing apparatus for post-processing sheets of paper after image forming, comprising:

a gate for taking in sheets of paper ejected from an image forming apparatus through a taking-in port and switching to either of a first conveying path for post processing or a second conveying path for non-post processing to convey said sheets of paper;

a tray attached to an upper part of said sheet finishing apparatus by a link mechanism which can rotate between a first height position for storing said sheets of paper ejected via said second conveying path and a second height position away from said upper part and has an angle of inclination substantially the same at either of said height positions;

a sheet guidance member for supporting rollers for clamping and conveying said sheets of paper passing said first conveying path and rotating between a first position where said one roller makes contact with another roller and a second position away from said another roller;

a connection member for connecting said link mechanism and said sheet guidance member so as to set said sheet guidance member at said first position when said tray is at said first height position and set said sheet guidance member at said second position when said tray is at said second height position, a processing mechanism for post-processing said sheets of paper conveyed via said first conveying path and an ejection mechanism for ejecting said sheets of paper post-processed by said processing mechanism, wherein rollers for clamping and conveying said sheets of paper passing said first conveying path are composed of upper and lower inlet rollers installed in the neighborhood of said taking-in port and upper and lower paper supply rollers for leading said sheets of paper requiring said post process to said processing mechanism.

6. The sheet finishing apparatus according to claim 5, wherein to avoid sudden rotation when said tray rotates from said first height position to said second height position, a damper mechanism is installed additionally.

* * * * *